US007024716B2

(12) United States Patent
Murakami

(10) Patent No.: US 7,024,716 B2
(45) Date of Patent: Apr. 11, 2006

(54) CLEANING APPARATUS FOR SCREEN MASK

(75) Inventor: Takehiko Murakami, Fuchu (JP)

(73) Assignee: Minami Co., Ltd, Tokyo (JP)

( * ) Notice: Subject to any disclaimer, the term of this patent is extended or adjusted under 35 U.S.C. 154(b) by 310 days.

(21) Appl. No.: 10/642,790

(22) Filed: Aug. 18, 2003

(65) Prior Publication Data

US 2004/0074023 A1 Apr. 22, 2004

(30) Foreign Application Priority Data

Aug. 26, 2002 (JP) ..... 2002-245086

(51) Int. Cl.
*B41F 35/00* (2006.01)
*A47L 25/00* (2006.01)

(52) U.S. Cl. ..... 15/3; 15/1; 101/424

(58) Field of Classification Search ..... 15/1, 15/3; 101/423, 424
See application file for complete search history.

(56) References Cited

U.S. PATENT DOCUMENTS 5,655,252 A * 8/1997 Miyawaki et al. ..... 15/308
6,036,787 A * 3/2000 Bennett et al. ..... 134/21
6,783,600 B1 * 8/2004 Tawara et al. ..... 134/6
2004/0049869 A1 * 3/2004 Tawara et al. ..... 15/41.1

FOREIGN PATENT DOCUMENTS

JP 6-297681 * 10/1994

* cited by examiner

*Primary Examiner*—Randall Chin
(74) *Attorney, Agent, or Firm*—R. Neil Sudol; Henry D. Coleman; William J. Sapone

(57) ABSTRACT

An automated cleaning apparatus, employed wherein a paste-like printing agent having a low viscosity is used in a screen printing machine, comprising a cleaning unit constituted by an adhesive tape, an adhesive tape take-up body, an adhesive tape delivery body and an adhesive tape pressing table arranged between the adhesive take-up body and the adhesive tape delivery body. The adhesive tape is taken up in the state that an adhesive surface is set upward, the adhesive tape being taken up in the reverse direction to a moving direction of the clearing unit and at a predetermined speed in correspondence to a moving speed of the cleaning unit, and the cleaning unit being moved upward at a starting end position, moved downward at a terminal end position and returned to the starting end position.

1 Claim, 2 Drawing Sheets

CLEANING APPARATUS FOR SCREEN MASK

BACKGROUND OF THE INVENTION

1. Field of the Invention

The present invention relates to a cleaning apparatus of a screen mask, and more particularly to a cleaning apparatus of a screen mask which is suitably employed in the case that a paste-like printing agent having a low viscosity is used in a screen printing machine.

2. Description of Conventional Art

In the screen printing machine, when printing, a part of a printing agent 102 such as a cream solder or the like tends to go around a lower surface of a screen mask 100 from a lower edge of a screen hole 101 of the screen mask and remain there, as shown in FIG. 6. Accordingly, it is necessary to stop the machine frequently to clean the screen mask.

Further, it is necessary to dismount the screen mask each time for this cleaning. Since cleaning is a manual process, too much man-power and time are required.

Further, on the other hand, if the printing agent is a paste-like printing agent having a low viscosity, it is possible to completely remove the printing agent only by lightly applying the printing agent to the screen mask and subsequently gently wiping the printing agent from the screen mask.

Further, as a result of various experiments, it has been found that it is desirable to use an adhesive tape as a material which serves a sufficient effect for wiping out only by lightly contacting the paste-like printing agent having the low viscosity and is preferable in the case of automatically cleaning by a machine.

SUMMARY OF THE INVENTION

The present invention is made by taking the points mentioned above into consideration, and is obtained as a result of various experiments. An object of the present invention is to provide a cleaning apparatus structured such that all of the problems mentioned above can be solved by automatically cleaning the screen mask by a machine, in the case of printing by using the paste-like printing agent having a low viscosity.

Accordingly, the gist of the present invention exists in a cleaning apparatus of a screen mask comprising a cleaning unit constituted by:

an adhesive tape which is brought into contact with a lower face of a screen mask with an adhesive surface of the tape facing upward;

an adhesive tape take-up body which is rotated at a predetermined speed by a rotation driving source and takes up the adhesive tape in the reverse direction to a moving direction of the cleaning unit and at a predetermined speed in correspondence to a moving speed of the cleaning unit;

an adhesive tape delivery body which holds the roll-shaped adhesive tape and delivers the adhesive tape to the adhesive tape take-up body; and an adhesive tape pressing table which is arranged between the adhesive tape take-up body and the adhesive tape delivery body and is in slidable contact with a lower face of the adhesive tape so as to press the adhesive tape to the lower face of the screen mask, wherein the cleaning unit is structured such as to be moved upward at a cleaning starting end position, be moved horizontally to a terminal end position, be moved downward at the terminal end position and be returned to the starting end position.

DESCRIPTION OF THE PREFERRED EMBODIMENT

A description will be given below of an embodiment in accordance with the present invention with reference to the accompanying drawings.

Figure 1:
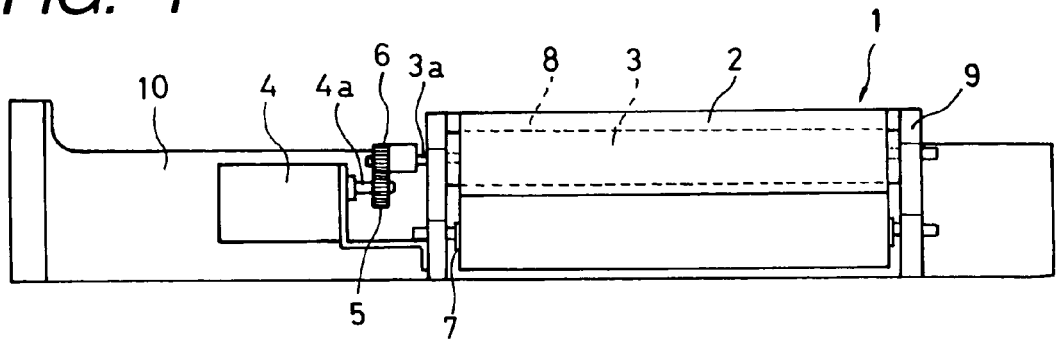
FIG. 1 is a front view of a main portion of the present invention.
Figure 2:
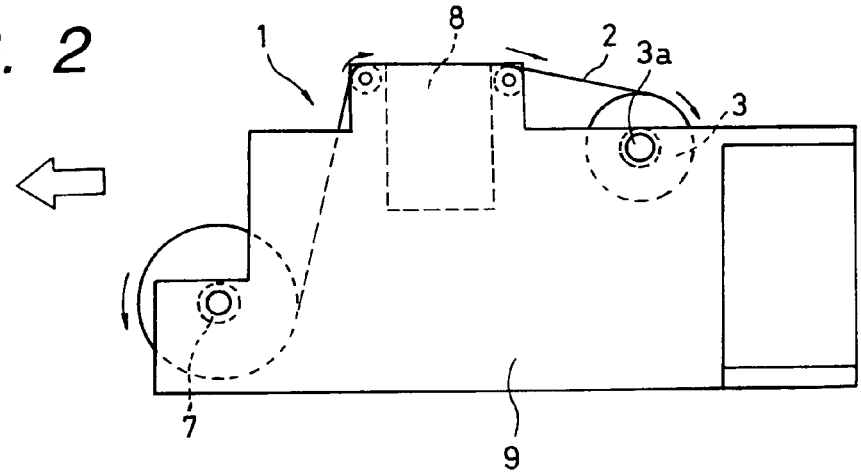
FIG. 2 is a right side view showing, on a larger scale, the main portion of the present invention.
Figure 3:
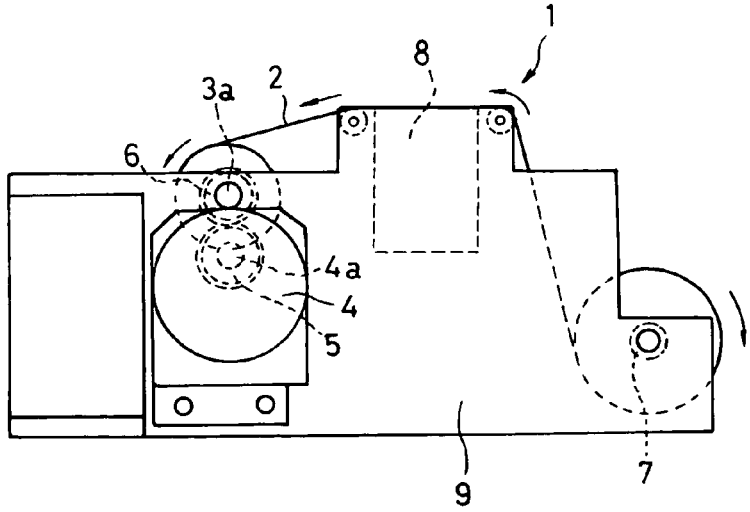
FIG. 3 is a left side view showing, on a larger scale, the main portion of the present invention.
Figure 4:
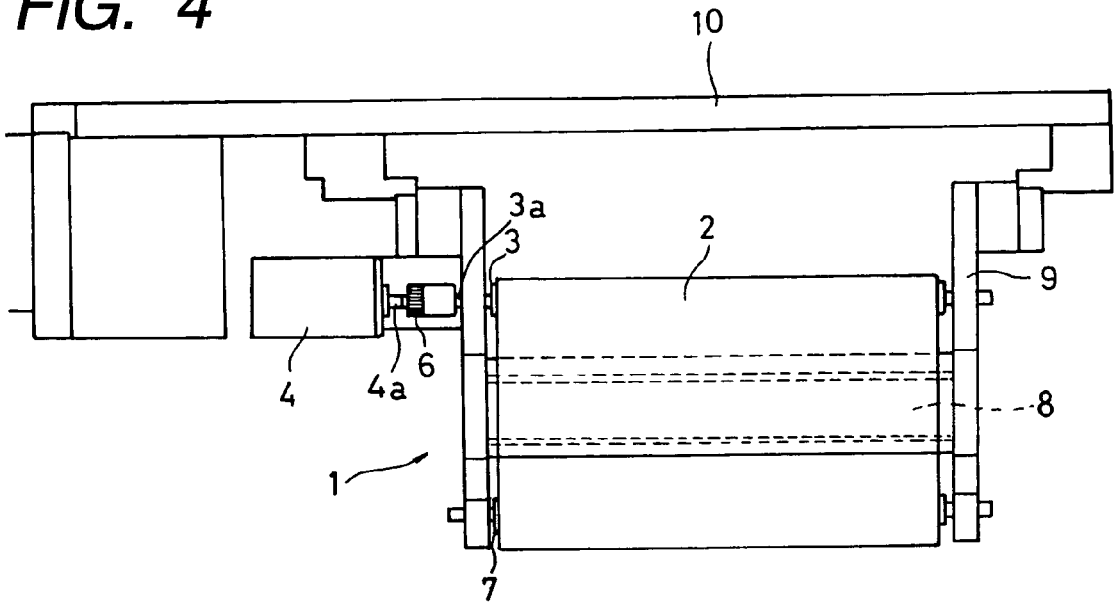
FIG. 4 is a plan view showing the main portion of the present invention.
Figure 5:
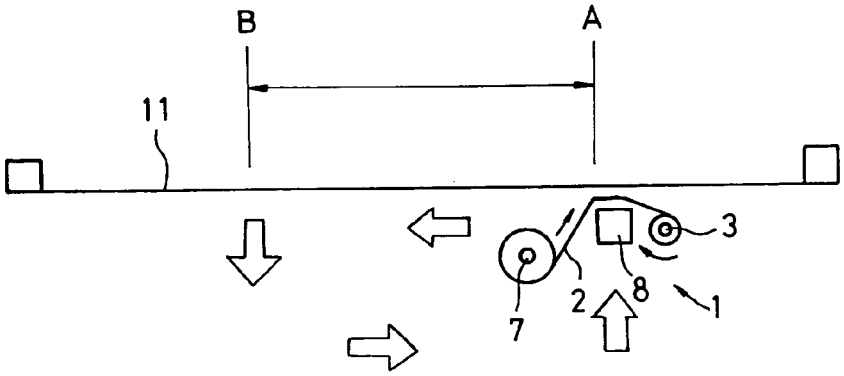
FIG. 5 is an explanatory view of an operation of the present invention.
Figure 6:
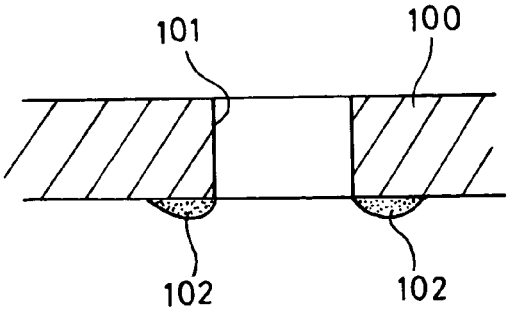
FIG. 6 is an explanatory view of a state in which a printing agent is left on a lower face of a screen mask after printing.

FIG. 1 is a front view of a main portion of the present invention, FIG. 2 is a right side view showing the main portion on a larger scale, FIG. 3 is a left side view showing the main portion on a larger scale, FIG. 4 is a plan view of the main portion, and FIG. 5 is an explanatory view of an operation.

In the drawings, reference numeral 1 denotes a cleaning unit. The cleaning unit 1 is constituted by an adhesive tape, an adhesive tape take-up body, an adhesive tape delivery body and an adhesive tape pressing table which are described below. Reference numeral 2 denotes an adhesive tape which is brought into contact with a lower face of a screen mask in a state in which an adhesive surface is set upward.

Reference numeral 3 denotes an adhesive tape take-up body. The adhesive tape take-up body 3 is rotated at a predetermined speed by a rotation driving source, and takes up the adhesive tape 2 in the reverse direction to a moving direction of the cleaning unit 1 and at a predetermined speed in correspondence to a moving speed of the cleaning unit 1. Further, reference numeral 4 denotes a motor corresponding to the rotation driving source. A gear 5 fixed to a rotation axis 4*a* of the motor 4 is meshed with a gear 6 fixed to an axis 3*a* of the adhesive tape take-up body 3.

Reference numeral 7 denotes an adhesive tape delivery body. The adhesive tape delivery body holds the roll-shaped adhesive tape 2, and delivers the adhesive tape 2 to the adhesive tape take-up body 3.

Reference numeral 8 denotes an adhesive tape pressing table. The adhesive tape pressing table 8 is arranged between the adhesive tape take-up body 3 and the adhesive tape delivery body 7, and is in slidable contact with the lower face of the adhesive tape 2 so as to press the adhesive tape 2 to a lower face of the screen mask.

Reference numeral 9 denotes a supporting frame for the respective members constituting the cleaning unit 1, and reference numeral 10 denotes a moving mechanism holding the supporting frame 9 and moving vertically and horizontally the supporting frame 9 at an appropriate timing. In this case, details of the moving mechanism is omitted. In addition, reference numeral 11 denotes a screen mask, in the drawings.

Next, a description will be given of an operation of the embodiment mentioned above.

In each time when a printing is performed by a squeegee (not shown), or after several printings are performed, the cleaning is performed. The cleaning is performed between a starting end A and a terminal end B in FIG. 5. Further, the cleaning unit 1 is moved upward in the starting end position A and is moved horizontally to the terminal end position B. At a time of the horizontal movement, the adhesive tape 2 is taken up by the adhesive tape take-up body 3 in the reverse direction to the moving direction of the cleaning unit 1 and at the predetermined speed in correspondence to the moving speed of the cleaning unit 1. Accordingly, the adhesive surface of the adhesive tape 2 is in contact with the lower face of the screen mask 11 without rubbing, and the printing agent left in the lower face of the screen mask 11 is stuck to the adhesive surface and is removed. Further, the cleaning unit 1 is moved downward in the terminal end position B, and is returned to the starting end position A. The operation mentioned above may be carried out only one time, or may be repeated several times.

The present invention has the structure and the operation mentioned above. Accordingly, in the case that the printing is performed by using the paste-like printing agent having the low viscosity, the cleaning of the screen mask can be automatically performed by the machine. Therefore, it is possible to solve all of the problems generated in the conventional case that the cleaning is performed by the manual work. Further, since the adhesive surface of the adhesive tape is in contact with the lower face of the screen mask without rubbing and the printing agent left on the lower face of the screen mask is stuck to the adhesive surface and is removed, it is possible to prevent the printing agent from being pressed back into the screen hole in the screen mask, this phenomenon being possibly generated due to the rubbing.

What is claimed is:

1. A cleaning apparatus for a screen mask in a screen printing machine using a paste-like printing agent having a low viscosity wherein the printing agent adhered to an underside of the screen mask is removed by a cleaning unit, said cleaning unit comprising:

an adhesive tape having an adhesive surface facing upward and brought into contact with the underside of said screen mask;

an adhesive tape take-up member driven by a rotation driving means for taking up said adhesive tape at a given speed;

an adhesive tape supply member for holding said adhesive tape in rolled form and delivering said adhesive tape to said take-up member; and an adhesive tape pressing table arranged between said take-up member and said supply member for pressing said adhesive tape to the underside of said screen mask while said tape slides on the table, wherein a driving mechanism causes said cleaning unit to be moved upward at a cleaning starting position, to be moved horizontally at a given speed from said starting position and to a cleaning completing position, to be moved downward at said cleaning completing position, and to be moved horizontally from said completing position to said starting position against, and wherein said take-up member, as driven by said rotation driving means, takes up said adhesive tape in a direction opposite to a direction of the horizontal movement of said cleaning unit from said starting position to said completing position at the speed of movement of said cleaning unit.

* * * * *